United States Patent [19]

Wirz

[11] Patent Number: 5,037,080

[45] Date of Patent: Aug. 6, 1991

[54] DEVICE FOR SCANNING THE LENGTH OF A SHEET IN A SHEET PROCESSING MACHINE, ESPECIALLY A SHEET-FED ROTARY PRINTING PRESS

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 488,695

[22] Filed: Mar. 5, 1990

[30] Foreign Application Priority Data

Mar. 4, 1989 [DE] Fed. Rep. of Germany ..... 3907037

[51] Int. Cl.[5] ..... B65H 3/08

[52] U.S. Cl. ..... 271/107; 271/108; 271/98; 271/227

[58] Field of Search ..... 271/107, 108, 227, 228, 271/258, 265, 260, 98

[56] References Cited

U.S. PATENT DOCUMENTS

| | | | |
|---|---|---|---|
| 3,294,396 | 12/1966 | Staines | 271/98 |
| 3,938,800 | 2/1976 | Wirz | 271/98 |
| 4,184,672 | 1/1980 | Watkins | 271/108 |

FOREIGN PATENT DOCUMENTS

| | | | |
|---|---|---|---|
| 630881 | 11/1961 | Canada | 271/107 |
| 0147319 | 3/1985 | European Pat. Off. . | |
| 347684 | 6/1919 | Fed. Rep. of Germany | 271/108 |
| 1220718 | 7/1966 | Fed. Rep. of Germany . | |
| 1640398 | 9/1971 | Fed. Rep. of Germany . | |
| 2318443 | 11/1973 | Fed. Rep. of Germany . | |
| 2524294 | 8/1976 | Fed. Rep. of Germany . | |
| 2621250 | 3/1977 | Fed. Rep. of Germany . | |
| 2606848 | 9/1977 | Fed. Rep. of Germany . | |
| 2132248 | 6/1979 | Fed. Rep. of Germany . | |
| 1379708 | 1/1975 | United Kingdom . | |
| 1557934 | 12/1979 | United Kingdom . | |
| 8706334 | 10/1987 | World Int. Prop. O. . | |

*Primary Examiner*—H. Grant Skaggs

*Attorney, Agent, or Firm*—Herbert L. Lerner; Laurence A. Greenberg

[57] ABSTRACT

A device for scanning the length of a sheet in a sheet-processing machine including suction-air measuring nozzles alignable with the trailing edge of the sheet and connected to a suction-air source via control elements connected in an electrical circuit of the machine drive, and a feeder for aligning the sheets to be processed at stops for the leading edge of the sheet, and for lifting sheets individually off a pile of sheets includes a fall-type sucker formed of at least one of the suction-air measuring nozzles, the fall-type sucker being formed with a scanning bore directed in the feeder towards the trailing edge of the uppermost sheet in the pile of sheets, and a differential-pressure-measuring valve disposed in a suction-air line connected to the fall-type sucker, said differential-pressure measuring valve being cooperatively associated with the control elements.

4 Claims, 3 Drawing Sheets

DEVICE FOR SCANNING THE LENGTH OF A SHEET IN A SHEET PROCESSING MACHINE, ESPECIALLY A SHEET-FED ROTARY PRINTING PRESS

The invention relates to a device for scanning the length of a sheet in a sheet-processing machine, particularly a sheet-fed rotary printing press, including suction-air measuring nozzles alignable with the trailing edge of the sheet and connected to a suction-air source via control elements connected in an electrical circuit of the machine drive, a feeder for aligning the sheets to be processed at stops for the leading edge of the sheet, and for lifting sheets individually off a pile of sheets.

Such a device has become known heretofore from German Patent 26 21 250 on a sheet-transfer drum of a sheet-fed rotary printing press for recto-and-verso or first form and perfector printing. Grippers for gripping the leading edge of a sheet and, also, suction-type grippers are disposed in longitudinally extending channels in the sheet-transfer drum in a line along the wall of the channel, and are connected to a suction-air source, for gripping the trailing edge of an advance-running sheet, two of the suction-type grippers being offset opposite the sheet-conveying direction with respect to the line, the suction-type grippers having a pressure monitor in their connecting line, so that the suction nozzles serve simultaneously as scanning nozzles in order to detect sheets of insufficient length, sheets with folded-over corners or dog-ears at the trailing edge thereof and other format defects, and in order to be able to shut down following printing units. In rotary printing presses for recto-and-verso or first form and perfector printing, short sheets are thereby detected, and suitable commands are triggered for controlling the press; for example, the next printing unit is switched off. If the trailing edge of a turned sheet were not gripped within the usual tolerance area or region by the grippers of the turning drum, this sheet might, in the following printing operations, be pulled entirely or partially out of the grippers, with resultant register errors. If a sheet is not gripped at all by its trailing edge in the turning apparatus, considerable consequential damage results, with the impression cylinder becoming inked and with the short sheet possibly travelling into the inking unit.

The aforementioned heretofore known device of this general type is not suitable for the detection of short sheets which, for example, because of electrostatic charging or the like, are entrained by the storage drum located upstream of a turning drum in a rotary printing press for recto-and-verso, i.e., first form and perfector, printing, due to which likewise considerable consequential damage results. At high press speeds, the problem caused by short sheets is particularly critical, because the length of time between the detection of the defect in the sheet and the possible necessity for shutting down the press is very short and may no longer be sufficient to prevent a short or otherwise defective sheet from entering the printing unit or to prevent printing by the impression cylinders.

Electrically or pneumatically operated means for monitoring defective sheets, particularly on the sheet turning device of rotary printing presses for recto-and-verso first form and perfector printing have also become known heretofore.

It is accordingly an object of the invention to provide a device for scanning the length of sheets so that sheets which are too short to pass through the printing units or which are otherwise unsuitable for printing are detected even before they enter the first printing unit, so that the press can be shut down before such a sheet is fed to the first printing unit by the feeder.

With the foregoing and other objects in view, there is provided, in accordance with the invention, a device for scanning the length of a sheet in a sheet-processing machine including suction-air measuring nozzles alignable with the trailing edge of the sheet and connected to a suction-air source via control elements connected in an electrical circuit of the machine drive, and a feeder for aligning the sheets to be processed at stops for the leading edge of the sheet, and for lifting sheets individually off a pile of sheets, comprising a fall-type sucker formed of at least one of the suction-air measuring nozzles, the fall-type sucker being formed with a scanning bore directed in the feeder towards the trailing edge of the uppermost sheet in the pile of sheets, and a differential-pressure-measuring valve disposed in a suction-air line connected to the fall-type sucker, the differential-pressure measuring valve being cooperatively associated with the control elements.

Suction-air measuring nozzles in the device according to the invention scan the sheets to be printed the instant they are lifted off the pile of sheets in the feeder and briefly remain with their front or leading edges in a stop position before the conveying means of the feeder accept the sheet and convey it across the feed table so as to come up against the front lays. This requires an additional suction-air control channel or line for the fall-type sucker, which acts as a suction-air measuring nozzle.

Due to the constructional features according to the invention, it is also possible to detect sheets of a short ream and an impermissible ream offset in the pile of sheets in the feeder, so that disruptions otherwise resulting therefrom can be prevented.

The features according to the invention are put to advantageous use in a feeder with a suction head having suction nozzles, which are directed substantially perpendicularly at the edge region at the rear or trailing edge of the uppermost sheet in the pile of sheets and are connected to a suction-air source. In addition to these suction nozzles, in the construction according to the invention, fall-type suckers acting as suction-air measuring nozzles are disposed in the suction head of the feeder and are offset towards the rear or trailing edge of the sheet with respect to the suction nozzles. An adjustment in the sheet-conveying direction permits the suction-air measuring nozzles to be aligned to the precise size of sheet and to a sheet length within the allowable tolerance limits. Sheet scanning makes use of the fact that the sheets, possibly preloosened by loosening blowers, are vertically raised individually from the pile by the suction nozzles of the suction head before the sheets begin to be conveyed horizontally in the feeder. Sheets which are detected as being defective, such as short sheets, for example, result in an immediate shutdown of the feeder by a differential-pressure-measuring valve, so that the defective sheet remains on the pile and can be removed. This prevents consequential damage due to any entry by such defective sheets of the printing units of the printing press.

In accordance with a further feature of the invention the feeder has suction nozzles formed as lift-type suckers connected to a suction-air source and disposed in a suction head, the lift-type suckers being directed substantially perpendicularly at the trailing edge region of the uppermost sheet in the pile of sheets, the fall-type sucker with the scanning bore being disposed in the suction head, offset towards the trailing edge of the sheet with respect to the lift-type suckers and adjustable in a direction in which the sheets are being conveyed.

In accordance with an additional feature of the invention, the fall-type sucker with the scanning bore is swivellable about an axis extending vertically to the plane of the sheets, and the scanning bore is disposed eccentrically with respect to the vertical axis.

In accordance with a concomitant feature of the invention, there is provided another suction-air line connecting the fall-type sucker with the scanning bore to a suction-air control valve, and means for blocking suction air from the fall-type sucker until after the sheet has been suction-gripped by the suction head.

Other features which are considered as characteristic for the invention are set forth in the appended claims.

Although the invention is illustrated and described herein as embodied in a device for scanning the length of a sheet in a sheet-processing machine, especially a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
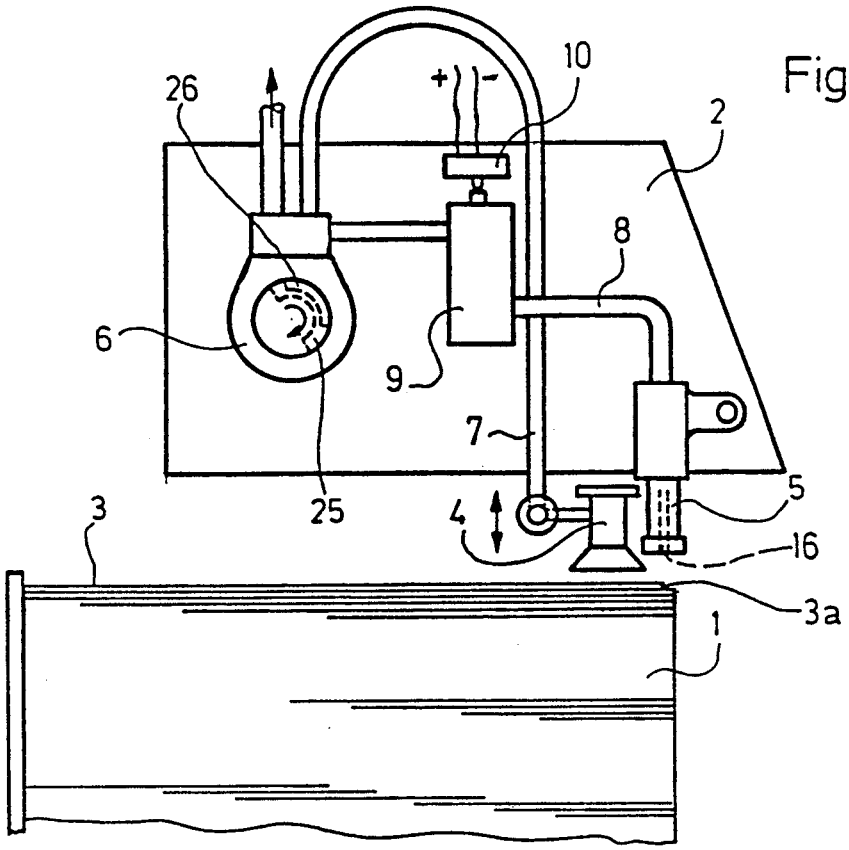
FIG. 1 is a diagrammatic side elevational view of a suction head of a sheet processing machine, namely a sheet-fed rotary printing press, above a pile of sheets.

Before specifically referring to the figures of the drawing, it is noted that scanning the lengths of sheets which are too short for passage through the printing units or otherwise unsuitable for printing is performed beforehand prior to entry of the sheets into the first printing unit, so that printing can be stopped before such a sheet is fed to the first printing unit by the feeder. In a similar manner, short sheets can also be detected in other sheet-processing machines in order to trigger control operations which prevent the processing of such sheets. For scanning the length of a sheet, suction-air measuring nozzles are provided in the feeder and are directed to the trailing edge of the uppermost sheet of the pile of sheets in the feeder, from which the machine lifts off the sheets individually and supplies them for processing.

Figure 2:
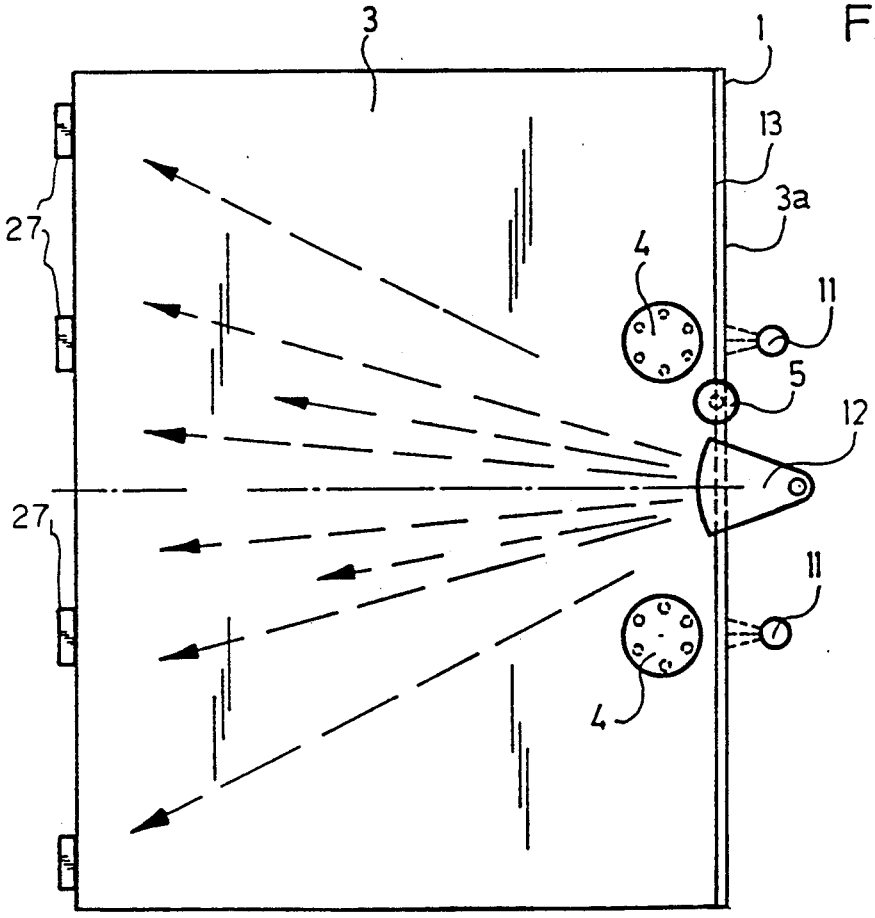
FIG. 2 is a top plan view of FIG. 1 showing diagrammatically an outline of a suction-nozzle arrangement of the suction head.

Referring now to the drawing and, first, particularly to FIGS. 1 and 2 thereof, there is shown therein a suction head 2 disposed in the feeder of a sheet-fed rotary printing press at a given distance above a pile 1 of sheets. The suction head 2 carries lift-type suckers 4 or other suction-air nozzles for lifting off an uppermost sheet 3 from the pile 1, and for conveying it into the feeder. The application of suction air to the lift-type suckers 4 or the like from a suction-air source represented by a vertical arrow at the top left-hand side of FIG. 2 is controlled by a rotary valve 5. In general, several of such lift-type suckers are disposed in the region of the rear or trailing edge of the pile 1 of sheets and at other locations at the sides of the sheets. When suction air is applied to the lift-type suckers 4, they lift off the uppermost sheet 3 from the pile 1 of sheets, so that carrying or support air can be blown under the sheet, and the front or leading edge of the sheet impacts with stops or stop flaps 27 and remains briefly in this position before being conveyed into the feeder. For the purpose of detecting short sheets in the pile 1, suction-air measuring nozzles are directed at and towards the rear or trailing edge 3*a* of the sheet so that the suction-air holes are closed if the sheet lifted off is of normal length.

These suction-air measuring nozzles are formed as fall-type suckers 5 and are disposed next to the lift-type suckers 4 for lifting off the uppermost sheet 3 from the pile of sheets 1. Such a fall-type sucker 5 or, advantageously, several fall-type suckers 5 are adjustable in the conveying direction of the sheet 3 and can, thereby, be aligned with respect to the rear or trailing edge of the pile 1 of sheets. Control of the suction-air supply is accomplished by a rotary valve 6, which has a control channel 25 for the lift-type suckers 4 (which are connected thereto via a suction-air line 7) and a further control channel 26 for the fall-type suckers 5 (which are connected thereto via a suction-air line 8) and act as suction-air measuring nozzles. Connected in the suction-air line 8 to the suction-air measuring nozzles is a differential-pressure measuring valve 9 with a microswitch 10, which is actuated by the differential pressure whenever a short sheet fails to close off the suction-air opening of the suction-air measuring nozzle. Several nozzles 11 are provided for the purpose of preloosening. By means of the nozzle 12, carrying air is blown under the sheet 3 which has been lifted off.

Figure 3:
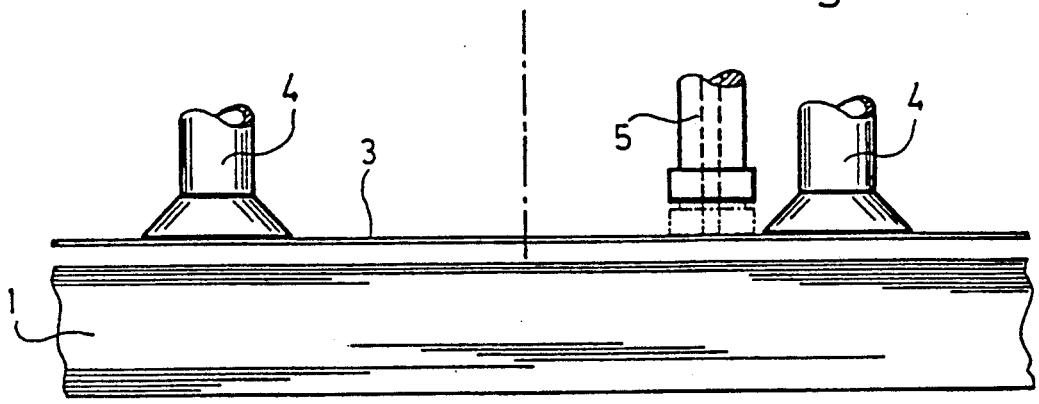
FIG. 3 is an enlarged diagrammatic rear elevational view of a suction head according to FIG. 1.

FIGS. 1 and 2 and the enlarged rear elevational view of FIG. 3 show the arrangement of the lift-type suckers 4 and the fall-type suckers 5.

Figure 4:
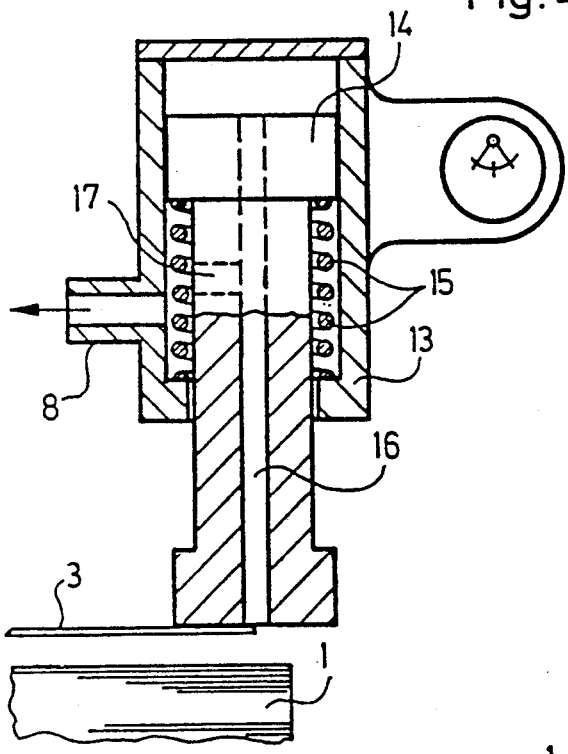
FIG. 4 is a vertical sectional view of a fall-type sucker formed as a suction-air-measuring nozzle.

A fall-type sucker 5 in the form of a suction-air measuring nozzle is shown in vertical sectional view in FIG. 4 on an again-enlarged scale with respect to FIGS. 1, 2 and 3. The fall-type sucker shown in FIG. 4 is horizontally adjustable and swivellable about a horizontal axis, and is formed of a housing 13 and a piston 14, which is axially displaceable in the housing under the action of a spring 15, and as a result of the pressure differences caused by the suction air. The piston 14 has an axial through-bore, which forms a scanning bore 16, and is connected to the suction-air line 8 via a transverse bore 17. The piston 14 is held in its upper end position by a spring 15. When compressed air is applied to the piston 14, it is lowered against the action of the spring 15 into the illustrated position of FIG. 4, and scans the rear or trailing edge of the sheet 3 which has been lifted off the pile 1. Sheets of normal length close off the scanning hole 16, with the result that there is no pressure difference with respect to the suction air in the suction-air system. If the scanning hole 16, as shown, is only partially closed, however, a pressure difference occurs, which acts upon the microswitch 10, with the result that, by means of the microswitch 10, it is possible to stop the printing or otherwise effect a partial shutdown of the machine.

Figure 6:
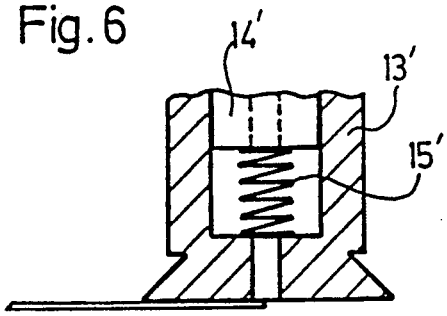
FIG. 6 is a fragmentary lower-end, vertical sectional view of an embodiment of a jump-type sucker in the form of a suction-air measuring nozzle.

FIG. 6 exhibits a reversal in the design principle for the fall-type sucker shown in FIG. 4. Thus, in the embodiment of FIG. 6, the piston 14' is fixed and the housing 13' is vertically axially displaceable on the piston 14 with the aid of the compression spring 15'.

Figure 5:
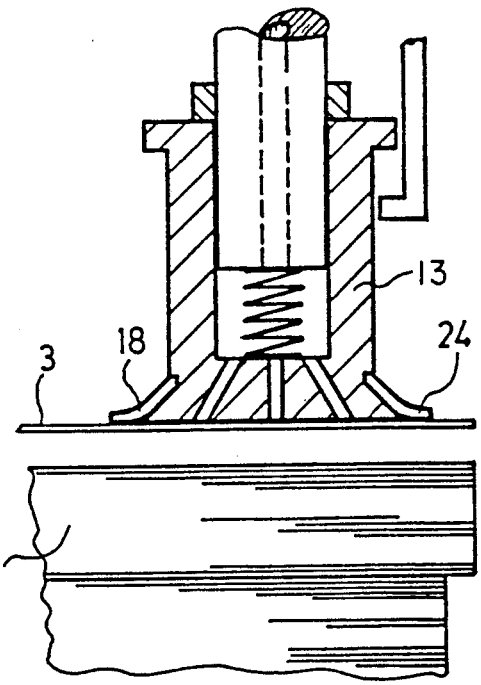
FIG. 5 is a vertical sectional view of a lift-type sucker.

The view of FIG. 5 illustrates a possible ream offset, which would be detected by a suction-air measuring nozzle according to the invention, and also the construction of a conventionally disposed lift-type sucker 4, which is not capable of detecting the ream offset. A lift-type sucker, of a construction similar to that of a so-called jump-type sucker, is surrounded at the lower edge thereof by an annular collar 18 of elastic material, which has a lower edge forming a sealing lip 24 for sealing the housing 13 with respect to the sheet 3 which has been lifted off the pile 1.

Figure 7:
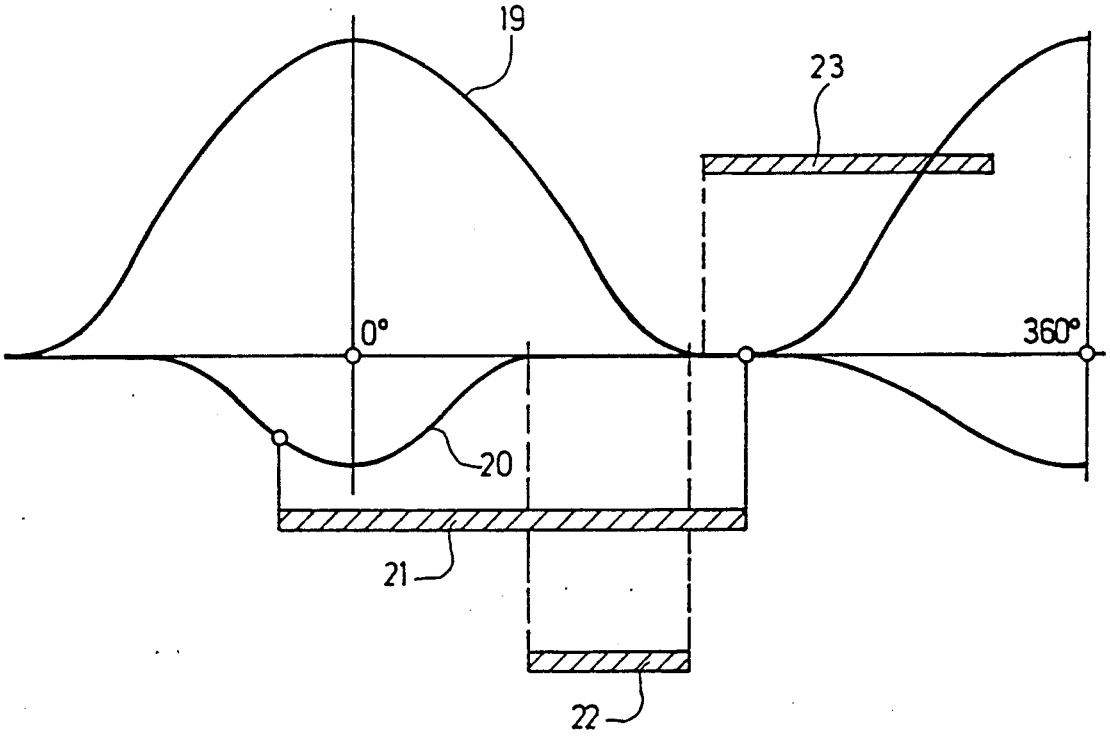
FIG. 7 is a plotted motion diagram for the lift-type suckers and suction-air measuring nozzles.

FIG. 7 is a plot diagram of the sequence of motion and for the air control in the suction head during one revolution of the machine (360 degrees). In the upper curve 19, the travel of the drag-type sucker is represented, and in the lower curve 20, the motion of the lift-type sucker. In the rotational-angle range represented by the reference numeral 21, the lift-type suckers 4 in the suction head are subjected to the action of suction air. During the shorter range 22 within the range 21, the suction-air measuring nozzle also is provided with a suction-air connection. The latter suction-air connection takes place immediately after the lift-type sucker has lifted off the uppermost sheet from the pile of sheets, and terminates just before the conveying suckers accept the sheet from the lift-type sucker. The drag-type suckers are provided with a suction-air connection within a rotational angle range 23.

I claim:

1. Device for sensing an end of a sheet in a sheet-processing machine including suction-air sensing nozzles alignable with the trailing edge of the sheet and connected to a suction-air source via control elements, and a feeder for aligning the sheets to be processed at stops for the leading edge of the sheet, and for lifting sheets individually off a pile of sheets, comprising a fall-type sucker formed of at least one of the suction-air sensing nozzles, said fall-type sucker being disposed above the sheet pile and being formed with a sensing bore directed downwardly in the feeder towards the trailing edge of the uppermost sheet in the pile of sheets, and a differential-pressure-measuring valve disposed in a suction-air line connected to said-fall-type sucker, said differential-pressure measuring valve being cooperatively associated with the control elements.

2. Device according to claim 1, wherein the feeder has suction nozzles formed as lift-type suckers connected to a suction-air source and disposed in a suction head, said lift-type suckers being directed substantially perpendicularly at the trailing edge region of the uppermost sheet in the pile of sheets, said fall-type sucker with said sensing bore being disposed in said suction head, offset towards the trailing edge of the sheet with respect to said lift-type suckers and adjustable in a direction in which the sheets are being conveyed.

3. Device according to claim 1, wherein said fall-type sucker with said sensing bore is swivellable about an axis extending vertically to the plane of the sheets, and said sensing bore is disposed eccentrically with respect to said vertical axis.

4. Device according to claim 1, including another suction-air line connecting said fall-type sucker with said sensing bore to a suction-air control valve, and means for blocking suction air from said fall-type sucker until after the sheet has been suction-gripped by the suction head.

* * * * *